United States Patent [19]

Kauffman et al.

[11] 4,456,118

[45] Jun. 26, 1984

[54] SINGLE TO DUAL INDEXING CARTON TRANSFER MECHANISM

[75] Inventors: Ivan L. Kauffman, Union Lake; Robert J. Allen, Farmington, both of Mich.

[73] Assignee: Ex-Cell-O Corporation, Troy, Mich.

[21] Appl. No.: 322,507

[22] Filed: Nov. 18, 1981

[51] Int. Cl.[3] ..... B65G 29/00

[52] U.S. Cl. ..... 198/480; 53/565; 493/182

[58] Field of Search ..... 198/425, 462, 480, 726; 493/180, 182; 53/375, 579, 565

[56] References Cited

U.S. PATENT DOCUMENTS

| | | | |
|---|---|---|---|
| 2,368,483 | 1/1945 | Monroe | 198/726 |
| 3,619,979 | 11/1971 | Martensson et al. | 53/375 |
| 4,148,170 | 4/1979 | Gaubert | 53/579 |

*Primary Examiner*—Joseph E. Valenza
*Assistant Examiner*—Jonathan D. Holmes
*Attorney, Agent, or Firm*—John P. Moran

[57] ABSTRACT

A single to dual indexing carton transfer mechanism involving a turret and conveyor, wherein the turret includes equally spaced mandrels which index at a first predetermined rate, and wherein the conveyor indexes at one-half the rate of the mandrels. Partially formed paperboard cartons are stripped from the respective mandrels as the latter index to their 6:00 o'clock position, and set on a stationary rail. A pusher mechanism is cammed to alternately transfer odd numbered cartons to the conveyor during the latter's dwell period, and even numbered cartons to the conveyor while it is indexing, thereby increasing the production rate along a single conveyor line.

4 Claims, 6 Drawing Figures

10
12
14
16
18
18a
18b
18c
18d
18e
18f
18g
18h
18i
20
22
24
25
26
27
28
30
32
34
36
38
40
44
62
64
66
68
70
72
82
88

SINGLE TO DUAL INDEXING CARTON TRANSFER MECHANISM

TECHNICAL FIELD

This invention relates generally to transfer means and, more particularly, to means for transferring individual cartons from an indexing turret to an indexing conveyor, while the turret is indexing twice as fast as the conveyor.

BACKGROUND ART

Heretofore, while it has been common practice to transfer selected items, such as cartons, from indexing turrets to indexing conveyors, such transfers have generally involved a common indexing rate relationship between the turret and the conveyor.

DISCLOSURE OF THE INVENTION

A general object of this invention is to provide an improved transfer means which is capable of receiving two successive cartons from successive mandrels of an indexing turret, and transferring the two cartons to two successive pockets of a conveyor during a single index of the latter.

Another object of the invention is to provide a transfer means including a turret having a predetermined number of equally spaced mandrels on which the bottom closure panels of four-sided paperboard tubes are individually indexed through pre-breaking, heating, and sealing stations, prior to being stripped fromm the respective mandrels and pushed individually onto a conveyor such that a first carton enters a pocket on the conveyor during its dwell and a second carton enters a successive pocket on the conveyor during its indexing movement. The cartons are thereafter conveyed past conventional filling and top sealing stations in pairs.

A further object of the invention is to provide a carton transfer means wherein an indexing cam for a turret including a plurality of mandrels, a cam for actuating a mandrel stripping unit, a cam for actuating a pusher mechanism in different alternate stroke distances, and an indexing cam for indexing a conveyor at half the rate of the turret are perfectly coordinated by virtue of being driven by one drive motor and shaft arrangement.

These and other objects and advantages of the invention will become more apparent when reference is made to the following description and accompanying drawings.

BEST MODE OF CARRYING OUT THE INVENTION

Figures 1, 2:
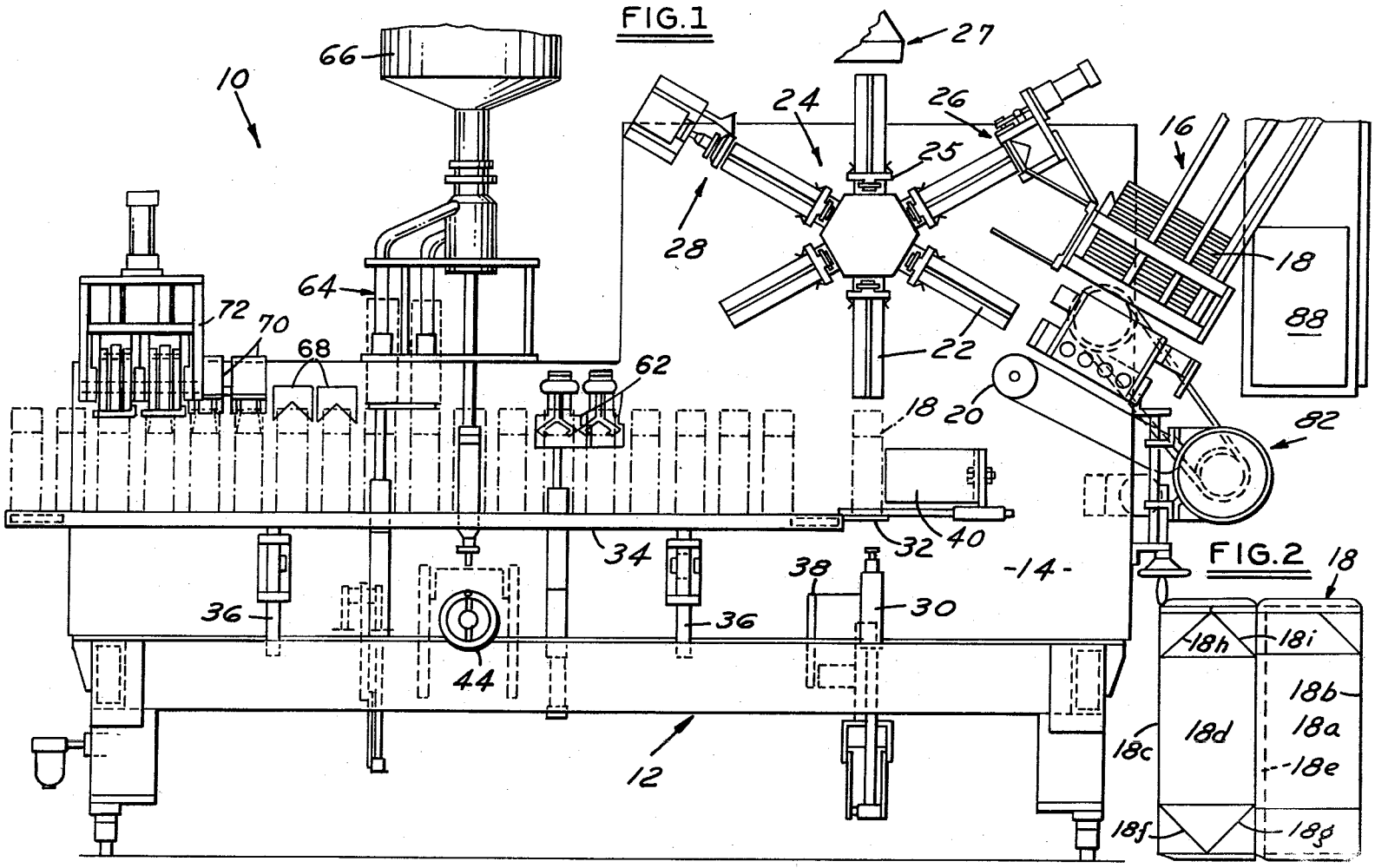
FIG. 1 is a side elevational view of a machine embodying the invention.
FIG. 2 is a layout view of a carton blank after it has been folded from a flat blank and side seamed into a four-sided flat structure suitable for being further formed into a rectangular tube, bottom sealed, filled with a liquid, and top sealed by the FIG. 1 machine embodying the invention.
Figures 5, 6:
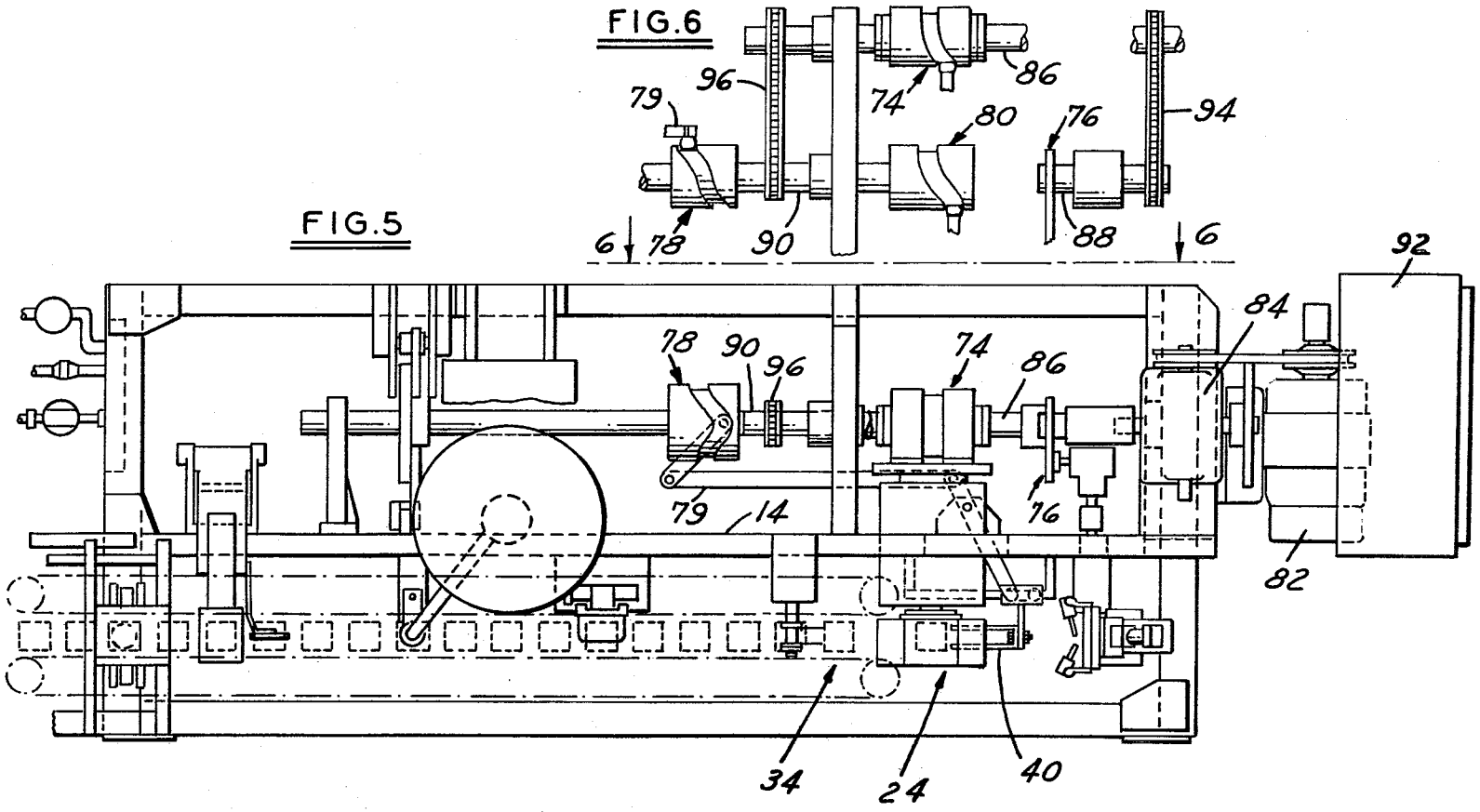
FIG. 5 is a plan view of the FIG. 1 machine embodying the invention.
FIG. 6 is a fragmentary side elevational view taken along the plane of the line 6—6 of FIG. 5, and looking in the direction of the arrows.

Referring not to the drawings in greater detail, FIG. 1 illustrates a forming, filling and sealing machine 10 of the liquid packaging type, including a base frame 12, and a vertical support keel 14 mounted along the longitudinal axis of the frame. The frame and keel are best shown in FIG. 5. The loading, forming, filling and sealing components are mounted on one side of the keel 14 as follows:

A magazine 16 for holding a plurality of paperboard blanks 18 is mounted on the one side of one end of the keel. The blanks 18 are illustrated in FIG. 2 as having four full width side panels 18*a*, 18*b*, 18*c* and 18*d*, and a side seam flap 18*e*, with the panels 18*b* and 18*c* being folded behind the panels 18*a* and 18*d*, respectively, and the flap 18*e* sealed to the inner edge portion of the panel 18*a*. A loading mechanism 20 is mounted on the keel just below the magazine 16 and adapted to withdraw one blank at a time from the magazine while opening same into a foursided tube and then to load such individual tube onto one of six mandrels 22 of an indexable turret mechanism 24. The latter is rotatably mounted on an upper portion of the keel 14. The receiving mandrel is positioned at 4:00 o'clock when a paperboard tube is slid thereon by the loading mechanism 20. An adjustable stop member 25 is operatively connected to each mandrel 22 to accommodate the forming of cartons having the same cross-section but different heights.

Figure 3:
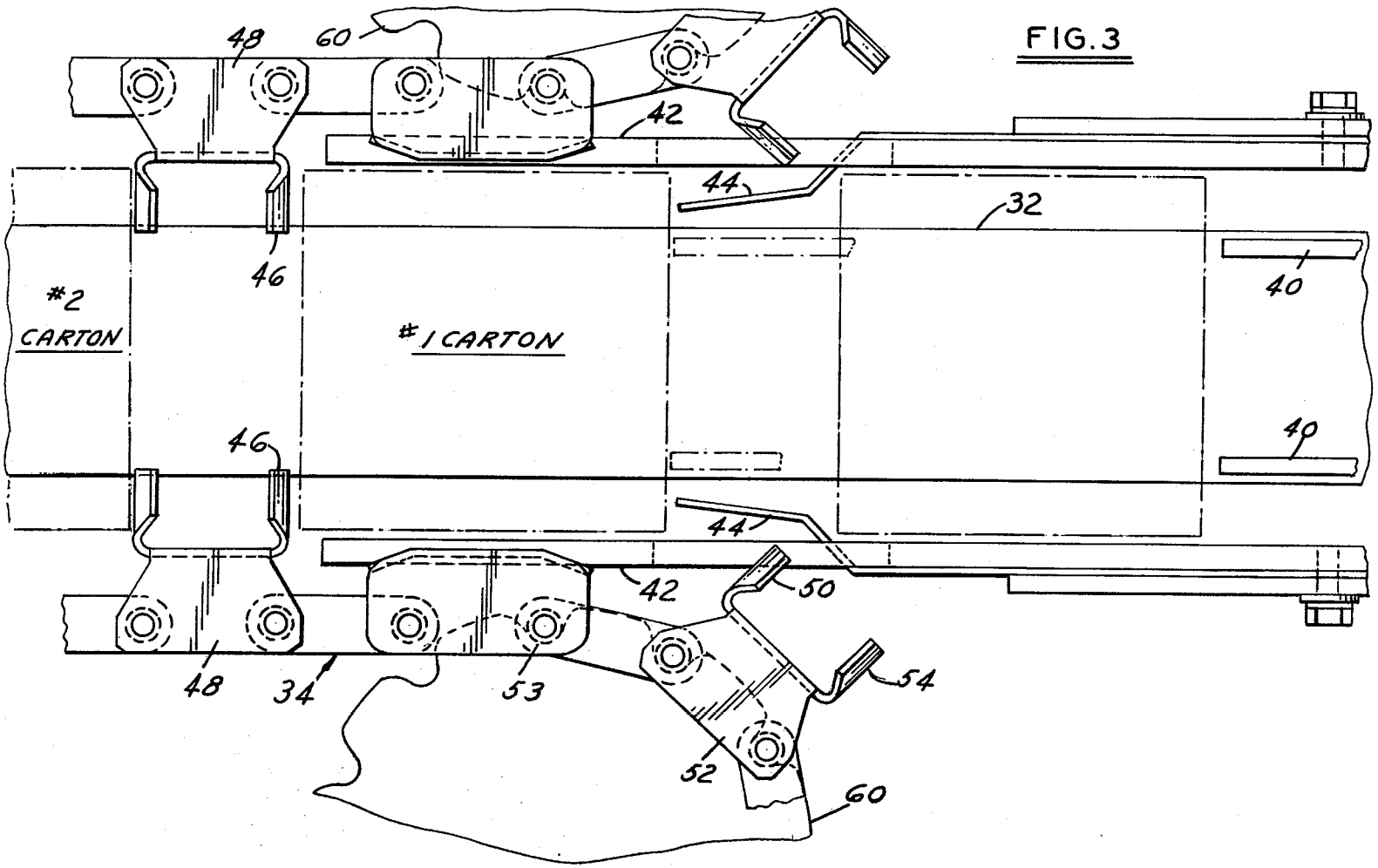
FIGS. 3 and 4 are schematic views of two operational steps embodied by the invention.

The mandrel indexes counterclockwise in FIG. 1 to a 2:00 o'clock position where two of the usual four bottom closure panels of the tube are pre-broken along performed score lines 18*f* and 18*g* (FIG. 2) by a prebreaker unit 26. At the 12:00 o'clock position, the four bottom closure panels are heated by a suitable heater 27 mounted on the other side (FIG. 3) of the keel 14 and extending over the upper edge thereof above the 12:00 o'clock mandrel. The bottom heated tube and mandrel 22 are next indexed to a 10:00 o'clock position where a closing and sealing unit 28 closes the bottom panels into an overlapped flat configuration, and under pressure, seals the overlapped panels together, changing the tube into a bottom sealed container or carton suitable for containing a liquid. Thereafter the bottom sealed carton is indexed to a 8:00 o'clock position where it continues to cool, prior to being indexed to an unloading 6:00 o'clock position.

At the latter position, the carton is stripped from the mandrel 22 by a stripping unit 30 and pulled downwardly to rest on a stationary rail 32 extending laterally from between a pair of parallel endless conveyors 34. As may be noted in FIG. 1, the rail 32 is supported on brackets 36 mounted on one side of the keel 14. The stripping unit 30 is also mounted on the keel 14, supported thereon by a bracket 38. As the conveyors index leftward in FIG. 1, the rotation of the turret mechanism 24 is coordinated with the movement of the conveyors so as to continuously supply bottom sealed cartons at regular intervals, ready fcr transfer to the conveyors in the following manner and operational sequence.

With the carton thus seated on the rail 32, it is in position to be transferred. During the dwell period of the conveyors 34, a transfer pusher 40 moves the first bottom-formed carton leftward in FIG. 1, along the rail 32 between guides 42, to a point just past a pair of oppositely disposed spring fingers 44 and just behind oppositely disposed lugs 46 of a pair of links 48 of the conveyors 34. The lugs 46 thus form the front of a conveyor pocket. As the conveyors begin their indexing cycle, oppositely disposed lugs 50 of the next pair of links 52 contact the rear edges of the carton and form the rear of the conveyor pocket. The lugs 50 continue to advance the carton, and the pusher 40 retracts. Oppositely disposed central lug members 53, intermediate adjacent links, such as the links 48 and 52, serve as a guide to each carton.

During the transfer period, the next mandrel 22 of the turret 24 indexes to the 6:00 o'clock position where the next carton is stripped from the mandrel by the stripping mechanism 30 and deposited on the rail 32, in position to be transferred. While the indexing cycle of the conveyors 34 is in process, the pusher 40 moves this newest carton horizontally along the rail 32 into the entrance to the parallel conveyors 34 behind the now moving lugs 54 of the links 52. In this instance, the pusher 40 is adapted to move a predetermined distance farther than it did for the preceding carton, in order to help assure that the carton keeps up with the moving conveyors until engaged thereby. The next-in-line lugs 56 of the next pair of links 58 are spread for enough apart, by virtue of being positioned around the drive sprockets 60 of the conveyors 34, to permit passage of the carton therepast. Once again the pusher 40 retracts, as the lugs 56 form the rear of the conveyor pocket, and the turret 24 indexes to present another carton to the stripper mechanism 30, ready for the next cycle of delivering two cartons from the turret 24 for each one index of the conveyors 34. It should be noted that the trailing lugs of the links 58 are functionally comparable to the lugs 46 of the links 48.

After a predetermined number of indexes of the conveyors 34, each succeeding pair of cartons is positioned beneath a pair of top pre-breaker units 62 where the two oppositely disposed panels of each carton are prebroken along their respective gable-shaped infold score lines **18*h* and 18*i* (FIG. 2). Each pair of cartons is next indexed into position beneath a pair of filling units 64, each of which feeds a measured volume of a particular liquid, such as milk, from a source 66 into the cartons. As the cartons index in pairs therefrom, their gable-type tops are folded, heated, and sealed by respective folding, heating, and sealing units 68, 70 and 72 mounted on the keel 14. Thereafter, at the end of the forward travel of the endless conveyors 34**, the closed cartons are discharged onto any suitable track unit (not shown) to be readied for shipment.

Insofar as the drive units are concerned for coordinating the above sequence of operations, it may be realized from FIGS. 5 and 6 that, in general, a first indexing cam unit 74 controls the operation of the turret 24, a cam or suitable crank 76 controls the operation of the stripping unit 30, a cam 78 and suitable linkage 79 controls the operation of the pusher 40, and a second indexing cam unit 80 controls the operation of the conveyor 34, all of which are coordinated for constant timing by virtue of being driven by one electric motor 82, worm gear drive unit 84, drive shaft 86, and driven shafts 88 and 90, in conjunction with a control box 92. Chains 94 and 96 interconnect the shafts 88 and 90 with the drive shaft 86. The indexing cam unit 74 is mounted on the drive shaft 86, the crank 76 connected to the driven shaft 88, and the cam 78 and indexing cam unit 80 both mounted on the driven shaft 90.

Figure 4:
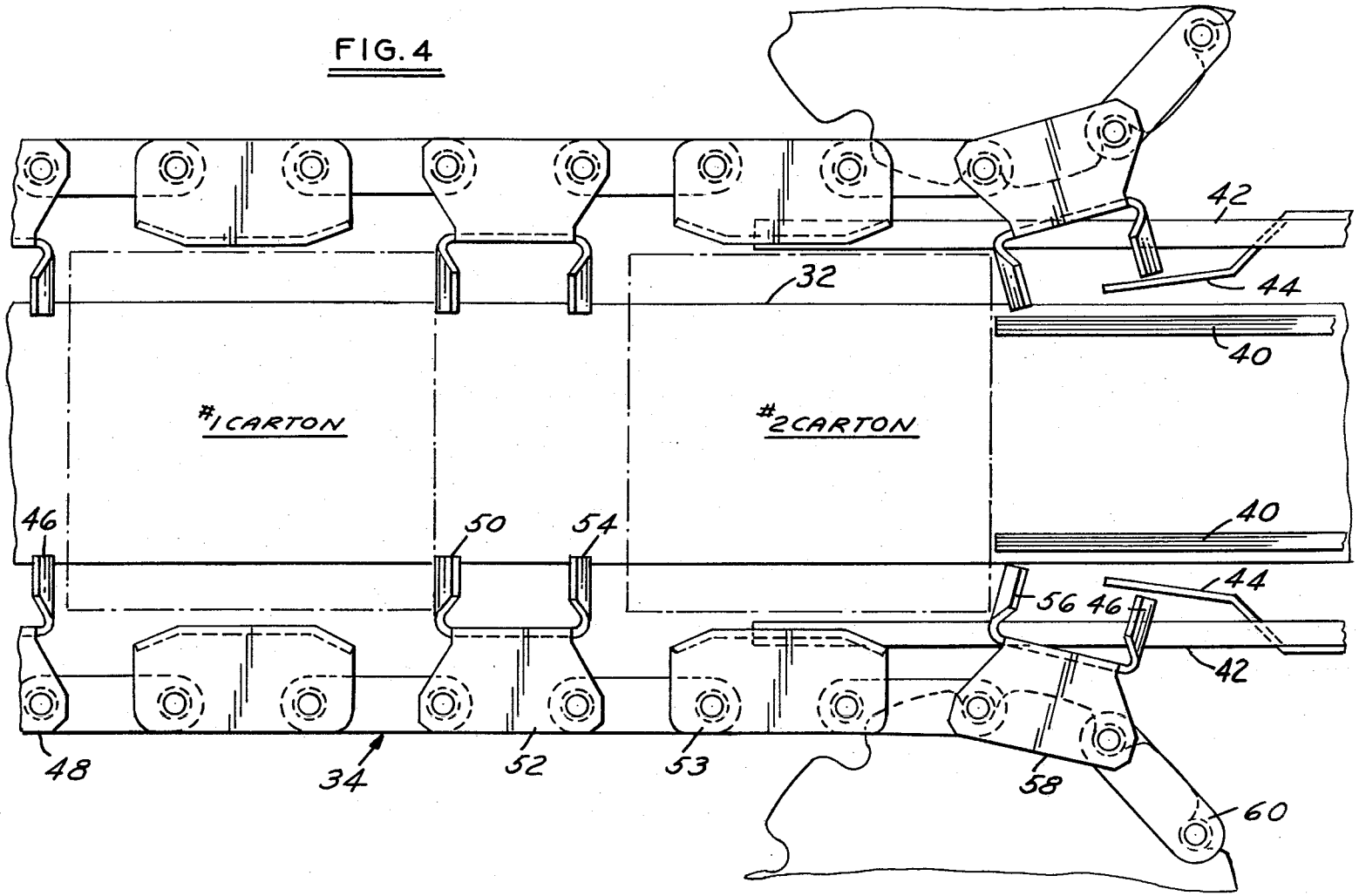

In operation, the turret 24 is caused to index twice for each index of the conveyors 34, and the stripping unit 30 is actuated in conjunction with each index of the turret. The conveyors 34 are caused to index once for each two indexes of the turret, receiving one carton while dwelling and a second carton while indexing. The pusher 40 is coordinated with the operation of the stripping unit 30 to push one carton to the ends of the spring fingers 44 (FIG. 3) during the conveyors' dwell period, and to alternately push the second carton a predetermined distance beyond the ends of the spring fingers (FIG. 4) during the conveyors' indexing step.

INDUSTRIAL APPLICABILITY

It should be apparent that the invention provides a novel transfer means for transferring two cartons from an indexing turret, and loading same onto conveyor means which index half as often as the turret, thereby efficiently and accurately increasing the production along a single conveyor line.

While but one embodiment of the invention has been shown and described, other modifications are possible.

The embodiments of the invention in which an exclusive property or privilege is claimed are defined as follows:

1. Transfer means for transferring cartons, said transfer means comprising a turret including a plurality of equally spaced mandrels, first indexing means for indexing said turret at a predetermined rate, a stationary rail, stripping means for stripping individual cartons from respective mandrels and sequentially placing said cartons on said stationary rail, conveyor means for conveying said cartons, second indexing means for indexing said conveyor means at half the rate of said turret, and pusher means for moving said individual cartons along said stationary rail onto said conveyor means such that every other carton enters said conveyor means during its dwell periods while respective cartons in between said every other carton enters said conveyor means during its indexing cycles.

2. Transfer means for transferring cartons, said transfer means comprising a motor, a drive shaft driven by said motor, a turret including a plurality of equally spaced mandrels, first indexing means operatively connected between said turret and said drive shaft for indexing said turret at a predetermined rate, a stationary rail, stripping means driven by said drive shaft for stripping individual cartons from respective mandrels and sequentially placing said cartons on stationary rail, conveyor means for conveying said cartons, second indexing means operatively connected between said turret and said drive shaft for indexing said conveyor means at half the rate of said turret, and pusher means driven by said drive shaft for moving alternate odd numbered cartons along said stationary rail onto said conveyor means during its dwell periods and moving alternate even numbered cartons along said stationary rail onto said conveyor means during its indexing cycles.

3. In transfer means for transferring cartons on a carton forming, filling and sealing machine including a turret having a plurality of equally spaced mandrels; loader means for loading paperboard tubes on individual mandrels; a stationary rail; conveyor means mounted adjacent said stationary rail and including pockets for receiving and conveying said cartons; the improvement comprising, first indexing means for indexing said turret at a predetermined rate; stripping means for stripping individual cartons from respective mandrels and sequentially placing said cartons on said stationary rail; second indexing means for indexing said conveyor means at half the rate of said turret; pocket means for moving said individual cartons along said stationary rail onto said conveyor means such that every other carton enters every other pocket of said conveyor means during its dwell periods while the cartons in between said every other carton enter the remaining alternate pockets of said conveyor means during its indexing cycles; and drive means for coordinating the operations of said first and second indexing means, said stripping means, and said pusher means.

4. In transfer means for transferring cartons on a carton forming, filling and sealing machine including a turret having a plurality of equally spaced mandrels; loader means for loading paperboard tubes on individual mandrels; a stationary rail; conveyor means mounted adjacent said stationary rail and including pockets for receiving and conveying said cartons; the improvement comprising, a drive shaft; first indexing cam means mounted on said drive shaft for indexing said turret at a predetermined rate; first and second driven shafts; connector means interconnecting said first and second driven shafts with said drive shaft; stripping means for stripping individual cartons from respective mandrels and sequentially placing said cartons on said stationary rail; crank means connected to said first driven shaft; second indexing cam means mounted on said second driven shaft for indexing said conveyor means at half the rate of said turret; pusher means for moving said individual cartons along said stationary rail onto said conveyor means, cam means mounted on said second driven shaft for actuating said pusher means such that every other odd numbered carton enters every other pocket of said conveyor means during its dwell periods while every other even numbered carton enters every other alternate pocket of said conveyor means during its indexing cycles.

* * * * *